US007637785B2

(12) United States Patent
Irish et al.

(10) Patent No.: US 7,637,785 B2
(45) Date of Patent: Dec. 29, 2009

(54) CONNECTOR WITH FLEXIBLE REGION

(75) Inventors: Kenneth G. Irish, Chicago, IL (US); Kevin L. Russelburg, Bolingbrook, IL (US)

(73) Assignee: Illinois Tool Works Inc., Glenview, IL (US)

( * ) Notice: Subject to any disclaimer, the term of this patent is extended or adjusted under 35 U.S.C. 154(b) by 3 days.

(21) Appl. No.: 12/176,741

(22) Filed: Jul. 21, 2008

(65) Prior Publication Data

US 2009/0061693 A1 Mar. 5, 2009

Related U.S. Application Data

(60) Provisional application No. 60/967,530, filed on Sep. 5, 2007.

(51) Int. Cl.
*H01R 9/03* (2006.01)

(52) U.S. Cl. ..... 439/658; 439/701

(58) Field of Classification Search ..... 439/658, 439/701, 596

See application file for complete search history.

(56) References Cited

U.S. PATENT DOCUMENTS 4,981,441 A * 1/1991 Ignasiak ..... 439/269.1
5,380,222 A 1/1995 Kobayashi
5,575,673 A * 11/1996 Dahlem et al. ..... 439/248
5,643,009 A * 7/1997 Dinkel et al. ..... 439/596
5,700,163 A * 12/1997 Okabe ..... 439/701
6,000,971 A * 12/1999 Hatagishi et al. ..... 439/701
6,235,420 B1 * 5/2001 Ng ..... 429/96
2002/0137397 A1 * 9/2002 Little ..... 439/686
2006/0141849 A1 * 6/2006 Trout ..... 439/465

FOREIGN PATENT DOCUMENTS

DE 1252262 B 10/1967
FR 2064591 A5 7/1971
FR 2458919 A1 1/1981

* cited by examiner

*Primary Examiner*—Briggitte R Hammond
(74) *Attorney, Agent, or Firm*—Mark W. Croll; Paul F. Donovan

(57) ABSTRACT

Electrical connectors that contain a flexible region are provided. In one embodiment, a connector has a first portion that includes several channels and a second portion that has one or more channels. One or more of the channels may include conductors for electrical connections. The connector further comprises a flexible region that is configured to flexibly connect the first portion with the second portion. Further aspects of the invention relate to connection systems that include a connector having a flexible region. The connection system comprises a connector and an element, such as a connecting block, having one or more mounting surfaces. An alignment feature may be used to align the connector block with a connector.

25 Claims, 5 Drawing Sheets

CONNECTOR WITH FLEXIBLE REGION

CROSS REFERENCE TO RELATED APPLICATIONS

This Non-Provisional Application claims benefit to U.S. Provisional Application Ser. No. 60/967,530 filed Sep. 5, 2007.

FIELD OF THE INVENTION

The present invention relates to the field of connectors and more particularly to the field of electrical connectors.

BACKGROUND OF THE INVENTION

Electrical connectors are known. Typically, installation personnel must install multiple, single connectors, which increases the possibility of crossing the wires at the connection points. This problem is often compounded with the fact that several connectors are usually located in close proximity and at least one connection includes a terminal or conductor that is at an opposing angle when compared to another connection. Therefore, improvements to known connectors would be beneficial.

SUMMARY OF THE INVENTION

Aspects of the invention relate to unique electrical connectors that contain a flexible region to permit the mounting of a single connector to multiple terminals that do not extend in the same direction. More specifically, in one embodiment, a connector has a first portion that includes several channels and a second portion that has one or more channels. One or more of the channels may include conductors for electrical connections. The connector further comprises a flexible region that is configured to flexibly connect the first portion with the second portion. In one embodiment, the flexible region is configured to be at a first position such that the channels of the first portion are parallel with the at least one channel of the second portion. The flexible region may further be configured to flexibly position the second portion to a second position wherein the channel of the second portion is at an angle with respect to the plurality of channels of the first portion. In another embodiment, the connector may include an alignment feature for controlling, in operation, alignment of the first portion with a mounting surface.

Other features and advantages of the invention will become apparent to those skilled in the art upon review of the following detailed description, claims and drawings in which like numerals are used to designate like features.

BRIEF DESCRIPTION OF THE DRAWINGS

FIG. 1A shows a top perspective view of an exemplary connector, and FIG. 1B shows a bottom perspective view of the exemplary connector.

DETAILED DESCRIPTION OF THE EMBODIMENTS

In modern electrical devices, electrical connections require a plurality of inputs and/or outputs. As can be appreciated, if multiple wires or conductors are needed in order to provide the needed input to and/or receive the desired output from the connection body, the cost of connecting each conductor can raise the price of the connection substantially. As the use of connectors on a module is a common design choice, an improved method of mounting a connector to a module may provide a substantial economic benefit. Furthermore, it is beneficial to have a single connector with a set of conductors so that a single operation can couple a set of conductors in a desired manner. The connector, as described below, comprises an integrated flexible region that connects one or more angled circuits or terminals and one or more straight circuits or terminals.

Figure 1A:
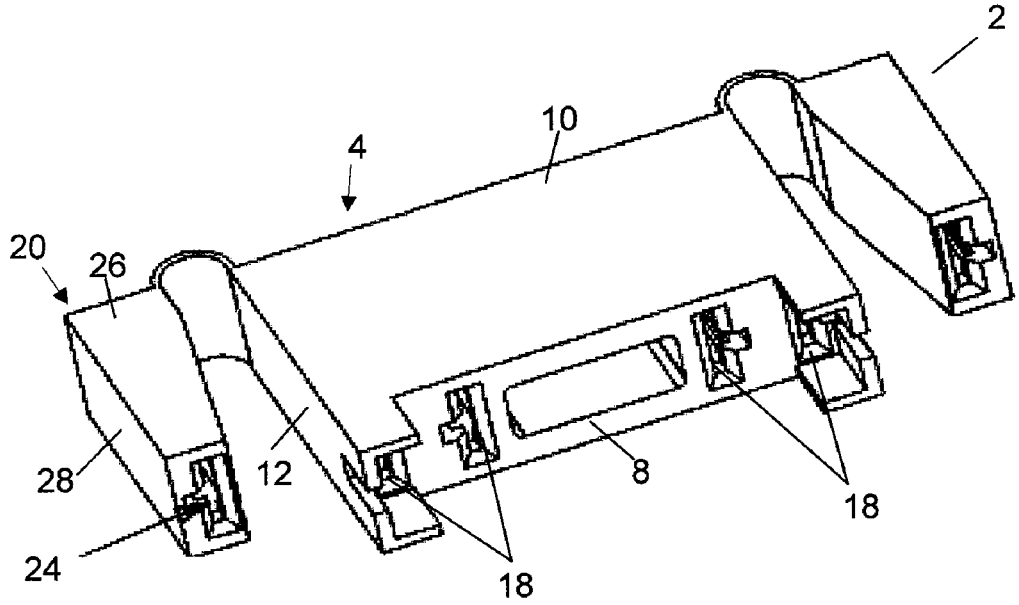
FIG. 1A and FIG. 1B show perspective views of an exemplary connector according to one embodiment of the invention. Specifically.
Figure 1B:
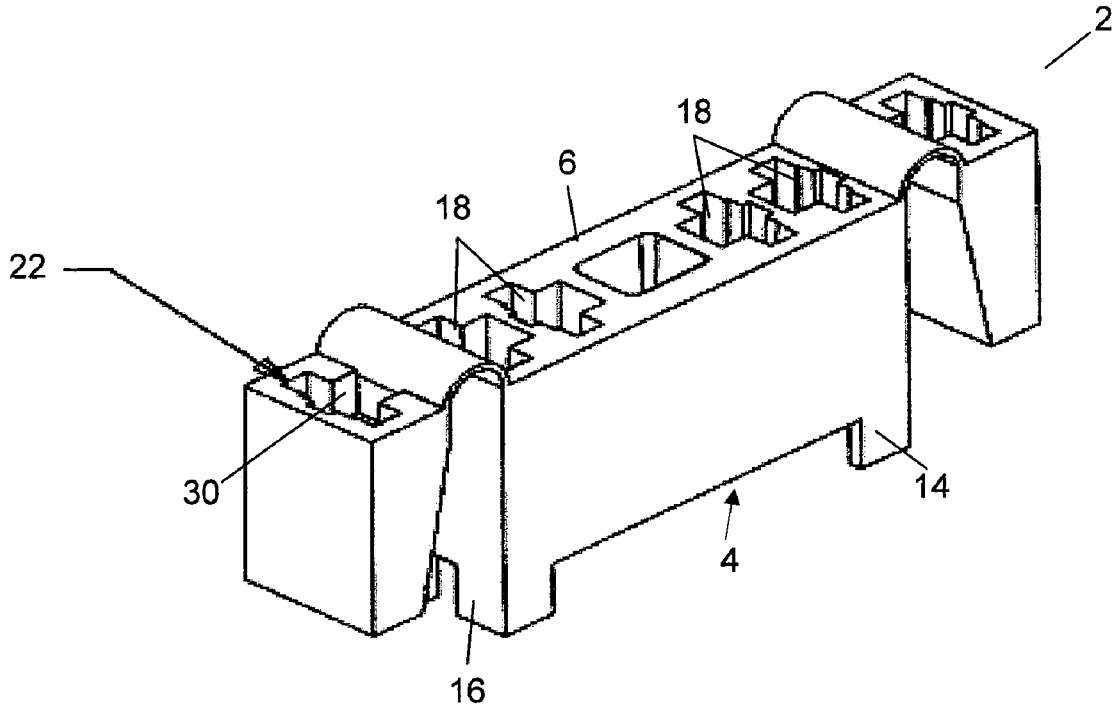

FIG. 1A and FIG. 1B show perspective views of an exemplary connector according to one embodiment of the invention. Specifically, FIG. 1A shows a top perspective view of exemplary connector 2, and FIG. 1B shows a bottom perspective view of exemplary connector 2. Connector 2 may comprise any non-conductive material, such as for example, plastic, nylon, rubber, and combinations thereof. Looking first at FIG. 1, connector 2 has a first portion 4. First portion 4 comprises a top (shown in FIG. 1B as element 6), a bottom 8, and a plurality of sides, such as sides 10 and 12 (see also sides 14 and 16 shown in FIG. 1B). The plurality of sides (i.e., 10, 12, 14, and 16) are arranged to form a perimeter of the first body portion 4. In the illustrated example, the plurality of sides 10, 12, 14, and 16 of the first body portion 4 extend from the top 6 towards the bottom 8 to create a substantially rectangular shaped perimeter. The shape and perimeter of the exemplary first body portion 4, however, is merely illustrative, and those skilled in the art will readily appreciate upon review of this disclosure that a myriad of shapes may be utilized without departing from the scope and the teachings of the invention. Indeed, in certain embodiments, the perimeter of the first portion may be a square, oval, a regular polygon, an irregular polygon, or combinations thereof.

The first body portion 4 further comprises a plurality of channels 18. As seen, the channels 18 are located within the perimeter of the first body portion 4 and extend from the top 6 to the bottom 8 of the first portion 4. The quantity, size, width and/or spacing of the channels may depend on a myriad of factors, such as: manufacturing specifications, tolerances, and/or the intended usage of the connector. Furthermore, in select embodiments, the material comprising the outer perimeter of the channels 18 may be different than the remaining material(s) forming the first portion 4.

Exemplary connector 2 further has a second portion 20 having a top (shown in FIG. 1B as element 22), a bottom 24, and a plurality of sides, such as sides 26, 28. As shown in the exemplary embodiment, the plurality of sides may extend from the top 6 to the bottom 8 defining a perimeter of the second portion 20. The second portion 20 further has a channel 30. The channel 30 of the second portion 20 may be identical to one or more of the channels 18 of the first portion 4. In further embodiments, second portion 20 has multiple channels 30. As shown in FIG. 1A, and described below, additional portions may be used with the connector 2. These additional portions may be mounted at any desirable position on the connector 2.

Figures 2A, 2B:
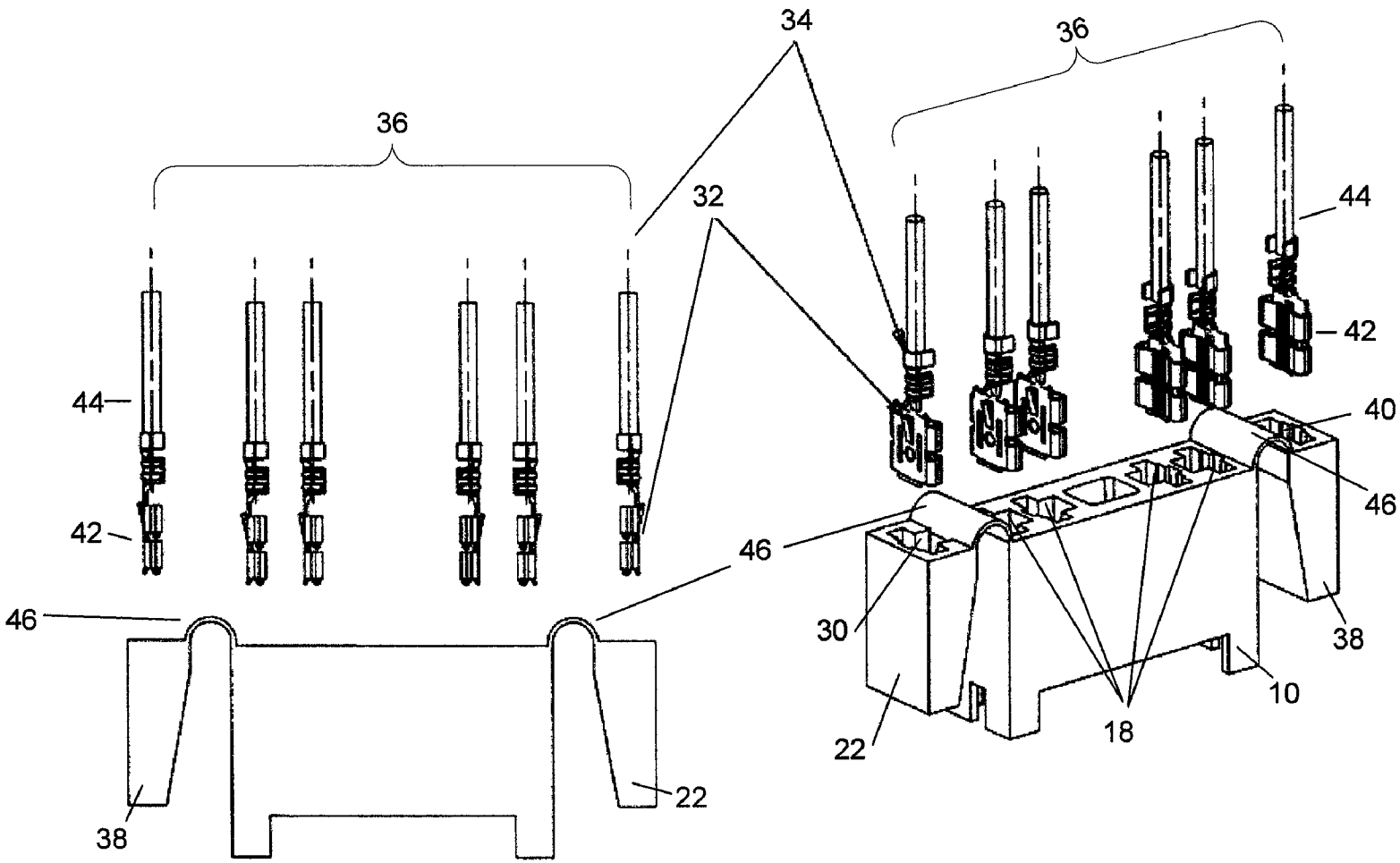
FIGS. 2A and 2B are perspective views of the exemplary connector shown in FIGS. 1A and 1B that further include conductors configured to fit within at least a portion of the channels of the connector.

In certain embodiments, the channels 18, 30 are shaped or otherwise configured to receive a conductor. The term "conductor" is well-known in the art and needs no further explanation. As best seen in FIGS. 2A and 2B, conductor 32 is configured to fit within at least a portion of channels 18, 30 to form an electrical connection between the conductor 32 and the channels. In the illustrated embodiment, conductor 32 is a "quick-connect" conductor. In one embodiment, the conductor comprises 0.187"×0.020" tabs for "quick connect" connections. In certain embodiments, conductor 32 may be configured to mate with miniature snap-action switches. In an exemplary embodiment, the channels 18, 30 are configured to retain the conductor 32 within the channels. In one such embodiment, the channels may be shaped to detachably retain the conductors, such that it may be replaced with another conductor. In one embodiment, the channels may be configured to retain two or more different types of conductors, thus increasing the versatility of connector 2.

Returning to FIGS. 2A and 2B, conductor 32 may be electrically attached to electrical wire 34. The type and gauge of the electrical wire 34 may depend on the type of conductor 32 utilized, the connector 2, and/or the requirements an electric device upstream or downstream from the wire 34. As further seen in FIGS. 2A and 2B, a plurality of conductors 36 (with or without wires) may be positioned within the plurality of channels 18 of the first portion 4 and the channels 30 of second portion 20 of the connector 2. There is no requirement that each of the plurality of conductors 36 be the same size, shape, material, or capable of transmitting the same electrical signal. Indeed, in certain embodiments, each of the conductors 36 are different with respect to one or more of the factors described above. Furthermore, while the illustrated embodiment shows conductor 32 as a "quick-connect" conductor, any conductor type may be implemented.

The exemplary embodiment has been described as a connector 2 having a first body portion 4 and a second body portion 20, however, those skilled in the art will readily appreciate upon full review of this disclosure that multiple body portions may be implemented according to the teachings of this disclosure. In fact, as best seen in FIGS. 2A and 2B, a third portion 38 may be used with the connector 2. The third portion 38 comprises channel 40. Additionally, conductor 42 which is electrically attached to wire 44 is configured to be placed within channel 40. Although the illustrated embodiment portrays third portion 38 as a mirror image of second portion 20, it is merely for illustrative purposes. There is no requirement that third portion 38 physically resembles second portion 20, or even first portion 4. A non-exhaustive list of differences includes, but is not limited to materials of construction, length, width, thickness, the attributes of the channel, and/or the type of conductor utilized.

Connector 2 also comprises at least one flexible region 46. The flexible region 46 joins or connects the first portion with the second and third portions of the connector. The flexible region may define a flat, bendable material. In one embodiment, the flexible region 46 may be in the form of a flexible strap. Numerous other shapes of the flexible region 46 are also possible. The features of the exemplary flexible region 46 are best observed when comparing FIGS. 2A and 2B with FIGS. 3A and 3B. Looking first to FIGS. 2A and 2B, flexible region 46 is configured to flexibly connect the top of first portion 4 with the top of second portion 20. A flexible region 46 may also connect the first portion 4 with an optional third portion, such as third portion 38. As shown in FIGS. 2A and 2B, the flexible region 46 may be placed at a first position such that the channels 18 of the first portion 4 are parallel with the channel 30 of the second portion 20. This position may be useful, for example, when manufacturing and/or assembling the conductors with the connector 2. This position may also be the position that connector 2 assumes when mounted to a mounting surface, as further described below.

Figure 3B:
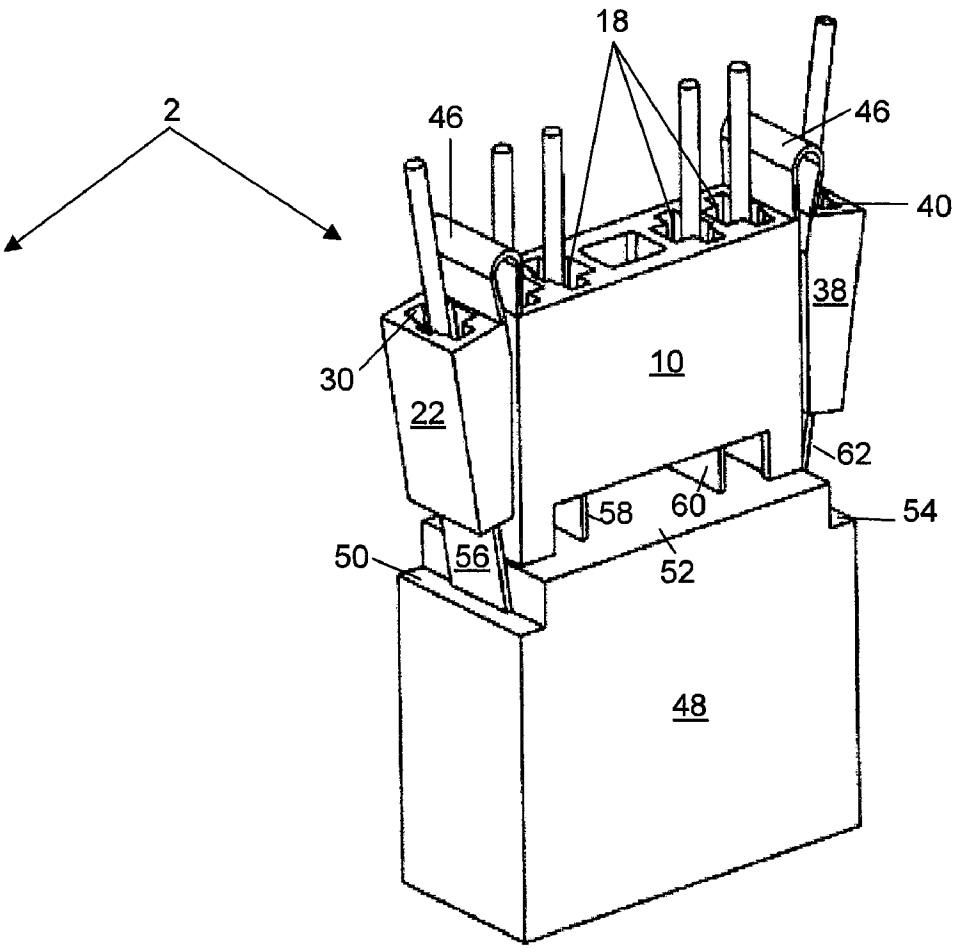
FIGS. 3A and 3B are perspective views of an exemplary connector connected to a connection block according to one embodiment of the invention.
Figure 3A:
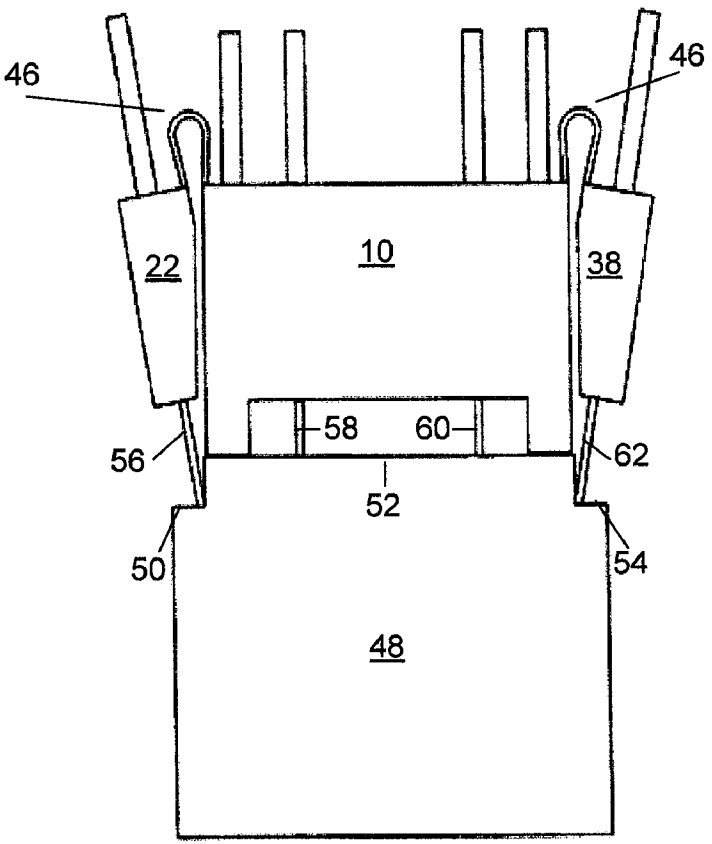

Looking next to FIGS. 3A and 3B, the flexible region 46 is further configured to flexibly position a portion of connector 2 to a second position. As seen in FIGS. 3A and 3B, the second portion 20 of connector 2 is positioned to a second position such that the channel 30 of the second portion 20 is at an angle with respect to the plurality of channels 18 of the first portion 4. Thus, the channel 30 of the second portion 20 is not substantially parallel to the channels 18 of the first portion 4. Other portions, such as third portion 38, may also be connected by a flexible region 46, to permit positioning such that the channel 40 of the third portion 38 is at an angle with respect to the plurality of channels 18 of the first portion 4. Thus, the flexible regions 46 may be used to position the second and third portions at different angles relative to the first portion to provide a versatile connector that may be used for a variety of applications.

Figure 3D:
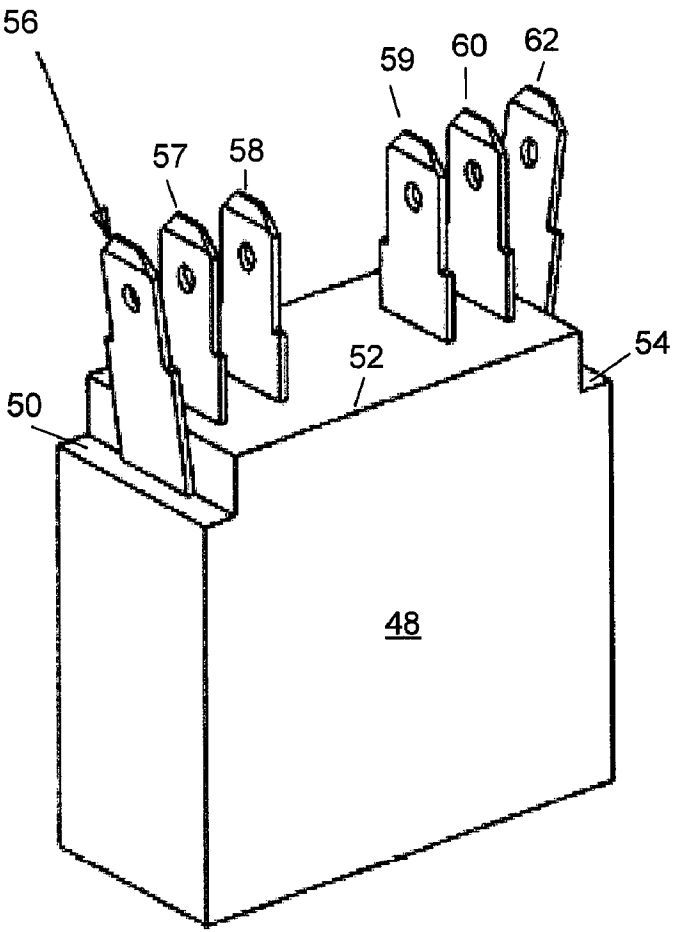
FIGS. 3C and 3D are perspective views of an exemplary connection block not connected to a connector according to one embodiment of the invention.
Figure 3C:
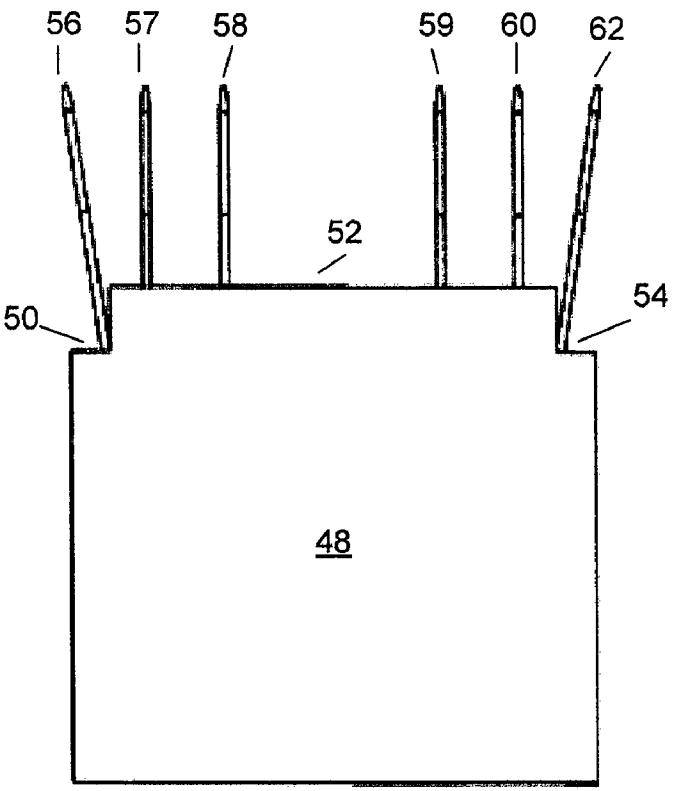

In one embodiment, the connector 2 may electrically engage one or more mounting surfaces, where at least one conductor of the connector 2 is in contact with a terminal or other conductor of the mounting surface. As seen in FIGS. 3A and 3B, exemplary mounting surface may be block 48 that has three mounting surfaces (surfaces 50, 52, and 54). As seen, each of the surfaces 50, 52, and 54 have at least one conductive terminal (terminals 56, 58, 60, and 62) that extend outwardly from the block 48. In some embodiments, the quantity of terminals on the mounting surfaces 50, 52 and 54 is equal to the number of conductors and/or channels on connector 2. For example, FIGS. 3C and 3D show the same exemplary block 48 as shown in FIGS. 3A and 3B, respectively, without being attached to connector 2. As shown, mounting surface 52 includes four terminals (labeled 57, 58, 59 and 60) that are configured to mate with the channels 18 of the first portion of connector 2. Yet in other embodiments there may be additional or fewer terminals on the mounting surface(s) 50, 52, and 54 than the quantity of conductors and/or terminals on connector 2. For example, block 48 may have two terminals 58 and 60 extending from mounting surface 52, which may be electrically connected to only two conductors within the channels 18 of first portion 4. Yet in another embodiment, mounting surface may have more terminals than channels 18 in the first portion 4.

As seen in FIGS. 3A and 3B, mounting surface 52 has two or more terminals 58, 60 that extend away from the mounting surface 52 in a substantially perpendicular direction. This configuration enables the electric connection between the terminals 58, 60 with any corresponding channels 18 within the first portion 4 of the connector 2. Mounting surface 50 has at least one terminal 56 extending outward from the surface at an angle relative to the terminals 58, 60. Similarly, mounting surface 54 has at least one terminal 62 extending outward from the surface at an angle relative to the terminals 58, 60. While mounting surfaces 50, 52, and 54 are substantially parallel to each other, other embodiments may utilize mounting surfaces that are not substantially parallel to each other. In one such embodiment, one or more terminals may extend from block 48 from a mounting surface that is perpendicular to mounting surfaces 50, 52, and 54. Furthermore, while the exemplary terminals 56 and 62 of the mounting surfaces 50 and 54, respectively are shown extending at an angle away from the terminals 58, 60, in other embodiments, one or more terminals may extend towards the general direction of the terminals 58, 60. The use of one or more flexible regions 46 allows an individual installing the connector 2 to adjust the angular alignment of the second and third portions so that they align with the terminals 56 and 62, even though these terminals do not extend parallel with the other terminals. In one embodiment, once channels 30 and 40 are aligned with terminals 58, 62, respectively, the individual may then apply a downward force on connector to connect all the channels 18, 30 and 40 of the connector with relative ease, thus completing the connection of the connector 2 with the block 48.

Figure 4B:
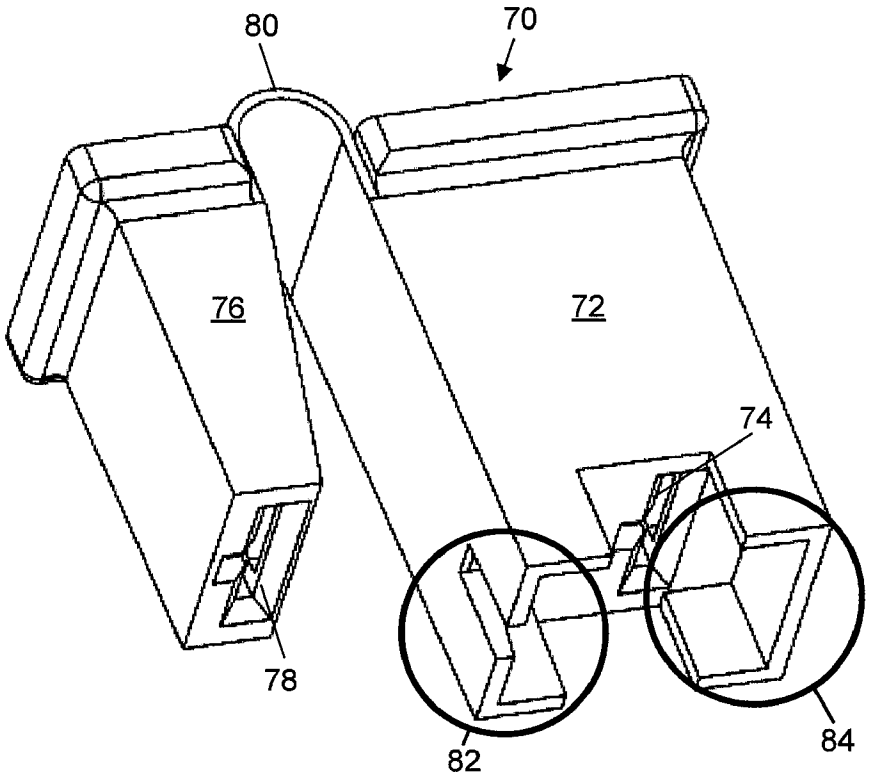
FIGS. 4A and 4B are perspective views of another exemplary connector according to another embodiment of the invention.
Figure 4A:
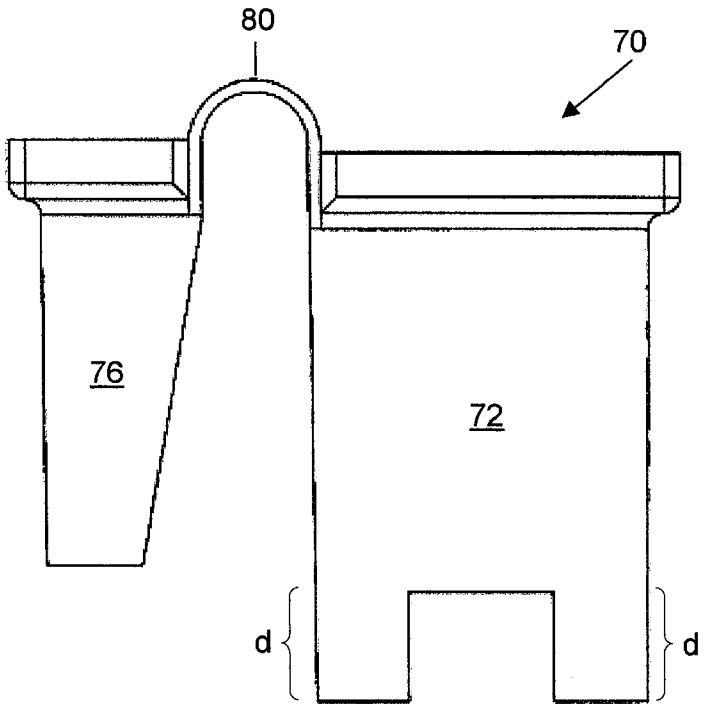

In certain embodiments, an alignment feature may be used to align the connector 2 with one or more mounting surfaces 50, 52, and 54. FIG. 4A and FIG. 4B show perspective views of a connector 70 according to an alternate embodiment of the invention. Specifically, FIG. 4A is a side view of connector 70, and FIG. 4B is a bottom side of connector 70. As shown, connector 70 has a first portion 72 with a plurality of channels 74 (note only one channel is visible in FIG. 4B). Second portion 76 (which has at least one channel 78) is connected to the first portion 72 by means of the flexible region 80. First portion 72 comprises alignment features 82, 84. In the illustrated embodiment, alignment features 82, 84 are positioned at the perimeter of first portion 72 to aid in aligning the connector 70 with a mounting surface. Yet in other embodiments, one or more alignment features 82 and 84 may be positioned more interior and are not required to be on the perimeter. Furthermore, in certain embodiments, only a single alignment feature may be implemented. While alignment features 82, 84 are located on the first portion 72, they may be utilized to assist in aligning the second portion 76 or other portions of the connector 70. For example, in one embodiment, the alignment features 82, 84 may separate the first portion 72 from a mounting surface by a specific distance (designated by "d" in FIG. 4A). The distance d may be the entire length of alignment features 82 and 84 or any portion thereof. Because second portion 76 is attached to the first portion 72, the use of alignment features 82, 84 also affects the distance of the second portion 76 to the same or different mounting surface, thus potentially providing more room to align the channel 78 of the second portion 76 with a terminal of a mounting surface.

While the exemplary alignment features 82, 84 have been shown as extensions to first portion 72, other implementations may include, but are not limited to one or more pegs, fasteners, and the like. Furthermore, in certain embodiments, a single asymmetrical shaped alignment feature may be sufficient to control the alignment of the connector 70 to a mounting surface. In one embodiment, not shown, the alignment feature may include a notch or recess in either the connector 70 or the mounting surface that is configured to accept a member or mounting feature extending from the connector 70.

Variations and modifications of the foregoing are within the scope of the present invention. It should be understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. An electrical connector comprising:

a first portion having a top, a bottom, and a plurality of sides extending from the top to the bottom defining a perimeter;

a plurality of channels located within the perimeter that extend from the top to the bottom of the first portion;

a second portion having a top, a bottom, and a plurality of sides extending from the top to the bottom defining a perimeter of the second portion, one of the sides being angled with respect to a side on an opposite side of the second portion so that the second portion has a frusto-wedge shape;

at least one channel located within the perimeter of the second portion that extends from the top to the bottom of the second portion; and a flexible region that is configured to flexibly connect the first portion with the second portion, wherein at a first position of the flexible region, the plurality of channels of the first portion are parallel with the at least one channel of the second portion, and wherein the flexible region is further configured to flexibly position the second portion to a second position wherein the channel of the second portion is at an angle with respect to the plurality of channels of the first portion, and wherein the side which is angled with respect to a side on the opposite side of the second portion is essentially parallel with a side of the first portion.

2. The electrical connector of claim 1, further comprising a plurality of conductors positioned within the plurality of channels of the first portion and at least one conductor located within the at least one channel of the second portion.

3. The electrical connector of claim 2, further comprising a plurality of electrical wires connected to the plurality of conductors.

4. The electrical connector of claim 1, wherein the flexible region flexibly connects the top of the first portion with the top of the second portion.

5. The electrical connector of claim 1, wherein the flexible region flexibly connects one of the plurality of sides of the first portion with one of the plurality of sides of the second portion.

6. The electrical connector of claim 1, wherein at least one of the plurality of sides of the first portion extends further along a longitudinal axis than at least another one of the plurality of sides of the first portion.

7. The electrical connector of claim 1, wherein at least one of the plurality of sides of the first portion extends further along a latitudinal axis than at least another one of the plurality of sides of the first portion.

8. The electrical connector of claim 1, wherein the first portion comprises two or four channels and the second portion comprises one channel.

9. The electrical connector of claim 1, further comprising an alignment feature for controlling, in operation, alignment of the first portion with a mounting surface.

10. The electrical connector of claim 9, wherein the alignment feature comprises at least one peg extending from the top of the first portion.

11. An electrical connection system comprising:

a first mounting surface having a plurality of terminals extending away from and perpendicular to the mounting surface;

a second mounting surface having at least one acutely angled terminal extending away from the second surface at an angle relative to the plurality of terminals on the first mounting surface;

a connector comprising:

a first portion having a top, a bottom, and a plurality of sides extending from the top to the bottom defining a perimeter;

a plurality of channels located within the perimeter that extend from the top to the bottom of the first portion configured to be aligned with the plurality of terminals of the first mounting surface;

a second portion having a top, a bottom, and a plurality of sides extending from the top to the bottom defining a perimeter of the second portion;

at least one channel located within the perimeter of the second portion that extends from the top to the bottom of the second portion; and a flexible region that flexibly connects the first portion with the second portion, wherein at a first position of the flexible region, the plurality of channels of the first portion are parallel with the at least one channel of the second portion, and wherein the flexible region is further configured to flexibly position the second portion to a second position wherein the channel of the second portion is aligned with the acutely angled terminal on the second mounting surface.

12. The electrical connection system of claim 11, further comprising a plurality of conductors positioned within the plurality of channels of the first portion and at least one conductor located within the at least one channel of the second portion.

13. The electrical connection system of claim 12, further comprising a plurality of electrical wires connected to the plurality of conductors.

14. The electrical connection system of claim 11, wherein the flexible region flexibly connects the top of the first portion with the top of the second portion.

15. The electrical connection system of claim 11, wherein the flexible region flexibly connects one of the plurality of sides of the first portion with one of the plurality of sides of the second portion.

16. The electrical connection system of claim 11, wherein at least one of the plurality of sides of the first portion extends further along a longitudinal axis than at least another one of the plurality of sides of the first portion.

17. The electrical connection system of claim 11, wherein the first portion comprises four channels and the second portion comprises one channel.

18. An electrical connector comprising:

a first portion having a top, a bottom, and a plurality of sides extending from the top to the bottom defining a rectangular perimeter;

a plurality of channels located within the perimeter that extend from the top to the bottom of the first portion, each channel comprising a conductor, the first portion having alignment features extending from the bottom of the first portion, the alignment features being adapted to engage a surface of a block and locate the first portion in a spaced relationship on the block so that terminals from the block extend into the channels in the first portion so as to establish electrical connection with the conductors in the channels;

a second portion having a top, a bottom, and a plurality of sides extending from the top to the bottom defining a perimeter of the second portion, and further including a channel having a conductor disposed therein located within the perimeter of the second portion that extends from the top to the bottom of the second portion;

a first flexible region configured to flexibly connect the first portion with the second portion, wherein at a first position of the flexible region, the plurality of channels of the first portion are parallel with the one channel of the second portion, and wherein the flexible region is further configured to flexibly position the second portion to a second position wherein the channel of the second portion is at an angle with respect to the plurality of channels of the first portion; and a third portion having a top, a bottom, and a plurality of sides extending from the top to the bottom defining a perimeter of the second portion, further including a channel having a conductor disposed therein located within the perimeter of the third portion that extends from the top to the bottom of the second portion; and a second flexible region configured to flexibly connect the first portion with the third portion, wherein at a first position of the flexible region, the plurality of channels of the first portion are parallel with the channel of the third portion, and wherein the flexible region is further configured to flexibly position the third portion to a second position wherein the channel of the third portion is at an angle with respect to the plurality of channels of the first portion.

19. The electrical connector of claim 18, wherein the first portion comprises four channels, the second portion comprises one channel, and the third portion comprises one channel.

20. The electrical connector of claim 18, wherein the first flexible region flexibly connects the top of the first portion with the top of the second portion and the second flexible region flexibly connects the top of the first portion with the top of the third portion.

21. The electrical connector of claim 1, wherein the first portion has alignment features extending from the bottom of the first portion, the alignment features being adapted to engage a surface of a block and locate the first portion in a spaced relationship on the block selected to permit the terminals from the block to extend into the channels in the first portion.

22. An electrical connector of claim 18, wherein the second portion is frusto-wedge-shaped, and wherein the third portion is frusto-wedge-shaped.

23. An electrical connector of claim 22, and wherein the first and second flex regions allow the second and third frusto-wedge-shaped portions to assume positions which facilitate the insertion of electrically conductive terminals that are angled acutely with respect to the parallel terminals that are accepted in the channels of the first portion, into the channels respectively formed in the second and third frusto-wedge-shaped portions.

24. An electrical connector of claim 21, wherein the alignment features extending from the bottom of the first portion, space the first portion from the block by a distance selected to locate the second portion in a position which facilitates the insertion of an acutely angled terminal thereinto.

25. An electrical connector of claim 18, wherein the alignment features extending from the bottom of the first portion, space the first portion from the block by a distance selected to locate the second and third portions in positions which facilitates the insertion of mirror image acutely angled terminals thereinto.

* * * * *